US007215299B2

(12) United States Patent
Planning et al.

(10) Patent No.: US 7,215,299 B2
(45) Date of Patent: May 8, 2007

(54) ANTENNA PROTECTED FROM DIELECTRIC BREAKDOWN AND SENSOR OR SWITCHGEAR APPARATUS INCLUDING THE SAME

(75) Inventors: Matthew F. Planning, Milwaukee, WI (US); Paul J. Rollmann, Brown Deer, WI (US); Mark G. Solveson, Oconomowoc, WI (US)

(73) Assignee: Eaton Corporation, Cleveland, OH (US)

( * ) Notice: Subject to any disclaimer, the term of this patent is extended or adjusted under 35 U.S.C. 154(b) by 170 days.

(21) Appl. No.: 10/963,047

(22) Filed: Oct. 12, 2004

(65) Prior Publication Data

US 2006/0077114 A1 Apr. 13, 2006

(51) Int. Cl.
*H01Q 1/42* (2006.01)

(52) U.S. Cl. ..... 343/872; 343/872; 343/876

(58) Field of Classification Search ..... 343/872, 343/873, 876, 700 MS
See application file for complete search history.

(56) References Cited

U.S. PATENT DOCUMENTS

| | | | | |
|---|---|---|---|---|
| 3,828,353 | A * | 8/1974 | Majkrzak et al. | 343/873 |
| 4,547,769 | A | 10/1985 | Tanigaki et al. | |
| 4,681,718 | A | 7/1987 | Oldham | |
| 4,725,449 | A | 2/1988 | Ehlers et al. | |
| 4,963,891 | A | 10/1990 | Aoyagi et al. | |
| 5,019,832 | A | 5/1991 | Ekdahl | |
| 5,206,596 | A | 4/1993 | Beihoff et al. | |
| 5,859,590 | A | 1/1999 | Otani | |
| 6,020,821 | A * | 2/2000 | Bauerschmidt et al. | 340/644 |
| 6,281,851 | B1 * | 8/2001 | Tay et al. | 343/702 |
| 6,373,358 | B1 | 4/2002 | Davies et al. | |
| 6,466,174 | B2 * | 10/2002 | Haussler et al. | 343/702 |
| 6,999,029 | B2 * | 2/2006 | Nakano et al. | 343/700 MS |
| 2006/0061512 | A1 * | 3/2006 | Asano et al. | 343/702 |

OTHER PUBLICATIONS

Sun Netscape Alliance, "Chapter 1, Introduction and Overview", http://media.wiley.com/product_data/excerpt/16/04712661/0471266116.pdf, Jun. 18, 2004, pp. 1-25.

Goldman, M. et al., "Gaseous Electronics", vol. 1 Electrical Discharges, Corona Discharges, 1978, pp. 219-221.

* cited by examiner

*Primary Examiner*—Tan Ho
*Assistant Examiner*—Dieu Hien Duong
(74) *Attorney, Agent, or Firm*—Martin J. Moran

(57) ABSTRACT

A switchgear apparatus includes a switchgear device, such as a circuit breaker, having a power bus, and an antenna element including an antenna member and one or more antenna leads. A material encapsulates the antenna member and is adapted to suppress dielectric breakdown through the material to the encapsulated antenna member from the power bus. The circuit breaker also includes a conductive housing having an opening receiving the antenna leads. The conductive housing is mounted on or proximate to the power bus. A sensor circuit is disposed in the conductive housing and is adapted to output a radio frequency signal to the antenna leads or to input a radio frequency signal from the antenna leads.

4 Claims, 3 Drawing Sheets

ANTENNA PROTECTED FROM DIELECTRIC BREAKDOWN AND SENSOR OR SWITCHGEAR APPARATUS INCLUDING THE SAME

BACKGROUND OF THE INVENTION

1. Field of the Invention

This invention pertains generally to antennas and, more particularly, to antennas for application in an environment subjected to a voltage potential where breakdown can occur. The invention also pertains to such antennas for application with sensors or switchgear devices.

2. Background Information

Diagnostic sensors that are located on the line or "high" voltage side of switchgear devices, such as circuit breakers, and/or on the bus structure of such devices must survive impulse voltage tests (e.g., rated lightning impulse voltage; BIL (Basic Impulse Level)) to prove that arcing between conductive surfaces does not occur. Survival of these tests is dependent upon the distance between the conductive surfaces, the rated breakdown of the material between those surfaces, the geometry of those surfaces and the applied voltage potential.

If such a diagnostic sensor might implement, for example, communications employing an antenna, then such antenna, if located outside of the package of the diagnostic sensor, may likely be subjected to arcing during the impulse voltage tests.

U.S. Pat. No. 4,725,449 discloses that problems have been encountered with radio frequency (RF) ion source antenna coils. When the antenna coil is made of bare metal, such as copper, sparking or arcing may occur in a vacuum chamber, both between the turns of the coil, and also between the coil and various electrodes which may be employed in the ion source. When the antenna coil is operated at high power levels, the RF voltage between different portions of the coil may be quite high. This patent further discloses an RF ion source antenna coil coated with a thin impervious layer or coating of glass which is fused to a metal conductor and is strongly adherent thereto. The glass coating covers the entire surface of the antenna conductor, but not including the terminal portions or contacts, which are left bare. The glass coating is thin, continuous, impervious and substantially uniform in thickness. The continuous, impervious glass coating is an excellent electrical insulator and is resistant to voltage breakdown. The patent also discloses that the glass coating will withstand a voltage of five kV.

There is room for improvement in antennas. There is also room for improvement in sensors and switchgear devices employing an antenna.

SUMMARY OF THE INVENTION

These needs and others are met by the present invention, which provides an antenna element including an antenna member that is encapsulated by a suitable high voltage breakdown material, in order to suppress dielectric breakdown through the material to the encapsulated antenna member from an electrical voltage potential. In one embodiment, the antenna is physically located outside of the corona discharge shield or conductive housing of a sensor.

The suitably high voltage breakdown material may be, for example, Cycloaliphatic epoxy, which has a dielectric strength of about 17 MV/m to about 18 MV/m as compared to air, which has a dielectric strength of about 3 MV/m.

The sensor including the encapsulated antenna member may be resident within a circuit interrupter and may communicate to, for example, another internal circuit without suffering the effects of severe radio signal attenuation, because the antenna member is not within the corona discharge shield or conductive housing of the diagnostic sensor and, yet, is able to withstand impulse voltage tests as a result of the encapsulated antenna member.

In accordance with one aspect of the invention, an antenna protected from external dielectric breakdown comprises: an antenna element comprising an antenna member and at least one antenna lead; and a material encapsulating the antenna member, the material being adapted to suppress dielectric breakdown through the material to the encapsulated antenna member from an external voltage potential.

The antenna element may include at least one square corner or square edge. The material encapsulating the antenna member may define a surface which encapsulates the antenna member, the surface including a first planar surface and a second surface, the second surface excluding any square corner, excluding any square edge, and including a plurality of rounded corners and a plurality of rounded edges.

As another aspect of the invention, a sensor comprises: an antenna element comprising an antenna member and at least one antenna lead; a material encapsulating the antenna member, the material being adapted to suppress dielectric breakdown through the material to the encapsulated antenna member from an external voltage potential; a conductive housing including an opening receiving the at least one antenna lead; and a sensor circuit disposed in the conductive housing, the sensor circuit adapted to output a radio frequency signal to the at least one antenna lead or to input a radio frequency signal from the at least one antenna lead.

The material encapsulating the antenna member may include a surface which is substantially larger than the opening. The surface of the material may be mounted on the conductive housing and may cover the opening thereof.

As another aspect of the invention, a switchgear apparatus comprises: a switchgear device comprising a power bus; an antenna element comprising an antenna member and at least one antenna lead; a material encapsulating the antenna member, the material being adapted to suppress dielectric breakdown through the material to the encapsulated antenna member from the power bus; a conductive housing including an opening receiving the at least one antenna lead, the conductive housing being mounted on or proximate to the power bus; and a sensor circuit disposed in the conductive housing, the sensor circuit adapted to output a radio frequency signal to the at least one antenna lead or to input a radio frequency signal from the at least one antenna lead.

The switchgear device may be a circuit breaker. The circuit breaker may include an internal wireless circuit adapted to communicate with the sensor circuit through the antenna element.

The switchgear device may be a bus structure adapted to be electrically connected to a circuit breaker.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein the term "antenna" shall expressly include, but not be limited by, any structure adapted to radiate and/or to receive electromagnetic waves, such as, for example, radio frequency signals.

As employed herein the term "switchgear device" shall expressly include, but not be limited by, a circuit interrupter, such as a circuit breaker; a bus structure for a circuit interrupter; a vacuum interrupter; a vacuum bottle; and/or other switchgear devices that are subjected to one or more voltage potentials where breakdown can occur.

As employed herein the term "encapsulated" or "encapsulating" shall expressly include, but not be limited by, embedded or embedding; surrounded by another material; and/or insert molded in another material.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The present invention is described in association with an antenna for a diagnostic sensor of a circuit breaker, although the invention is applicable to a wide range of sensor and/or antenna applications in an environment including a voltage potential where breakdown can occur.

Figure 1:
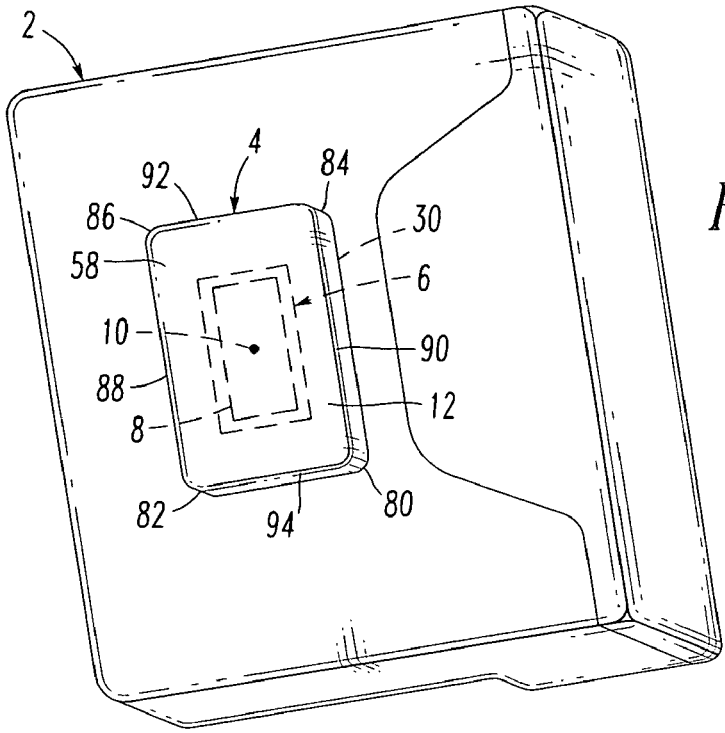
FIG. 1 is an isometric view of a diagnostic sensor including an antenna in accordance with the present invention.
Figure 2:
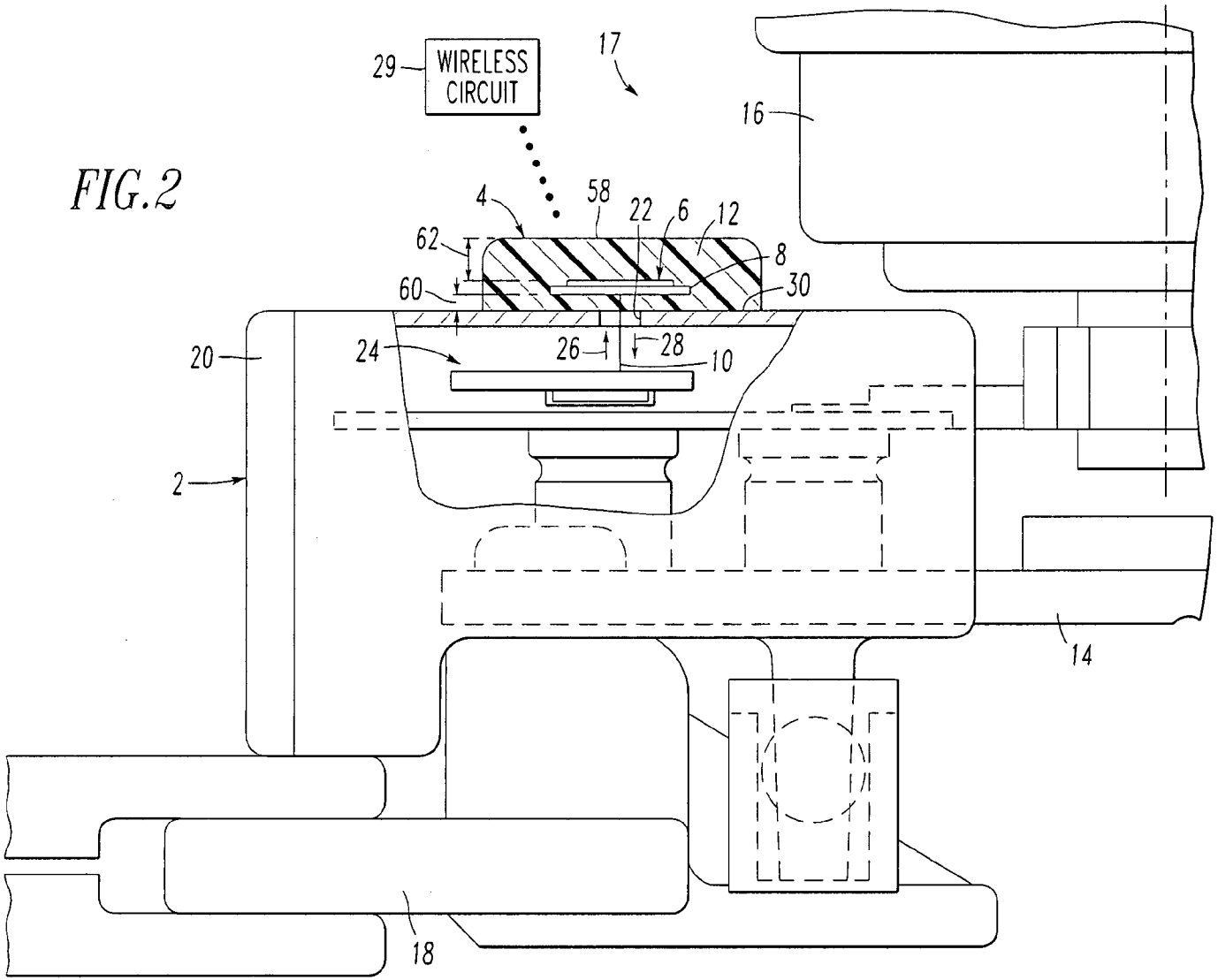
FIG. 2 is a vertical elevation view of a portion of a circuit breaker vacuum bottle and power bus including the diagnostic sensor and antenna of FIG. 1.

Referring to FIG. 1, a diagnostic sensor 2 includes an external antenna 4. The antenna 4, which is protected from dielectric breakdown, includes an antenna element 6 having an antenna member 8 and at least one antenna lead 10 (as best shown in FIG. 2 with the one antenna lead 10). The antenna 4 also includes a material 12 encapsulating the antenna member 8. The material 12 is adapted to suppress dielectric breakdown through such material to the encapsulated antenna member 8 from an external voltage potential.

EXAMPLE 1

The material 12 may be a suitable casting and potting material, such as a Cycloaliphatic epoxy, having a dielectric strength of about 17 MV/m to about 18 MV/m, although a wide range of different dielectric strengths may be employed.

EXAMPLE 2

The antenna element 6 and the antenna member 8 may be adapted to communicate in a low-rate wireless network (not shown), such as a low-rate wireless local area network (LR-WLAN). Alternatively, any suitable communication protocol may be employed.

EXAMPLE 3

The dielectric strength of an insulating material is the maximum electric field strength that it can withstand intrinsically without breaking down and experiencing failure of its insulating properties (e.g., a dielectric breakdown through the material). The higher the dielectric strength (expressed as volts per unit thickness) of a material the better its quality as an insulator. Knowing the breakdown or dielectric strength of the material 12 being employed in, for example, MV/m, and the voltage (e.g., of a power bus structure, such as power bus 14 or 18 of FIG. 2) of interest, the worst-case required thickness of the material 12 employed around the antenna member 8 may be calculated. For example, if the desired protection is a voltage of 100 kV (as applied, for example, to the surface of the material 12 as a worst case scenario), and if the dielectric strength of the material 12 is for example, 17 MV/m, then 0.0059 meters (=1/17 MV/m/100 kV) or 5.9 mm of the material 12 is employed around the antenna member 8.

EXAMPLE 4

The dielectric constant, $\epsilon_r$, is the ratio of the permittivity of a substance, $\epsilon$, to the permittivity of free space, $\epsilon_o$. The dielectric constant is an expression of the extent to which a material concentrates electric flux, and is the electrical equivalent of relative magnetic permeability. As the dielectric constant increases, the electric flux density increases, if all other factors remain unchanged. A high dielectric constant, in and of itself, is not necessarily desirable. Generally, substances with high dielectric constants breakdown more easily when subjected to intense electric fields, than do materials with low dielectric constants. For example, dry air has a low dielectric constant, but it makes an excellent dielectric material for capacitors used in high-power radio-frequency (RF) transmitters. Even if air does undergo dielectric breakdown (a condition in which the dielectric suddenly begins to conduct current), the breakdown is not permanent. When the excessive electric field is removed, air returns to its normal dielectric state. Solid dielectric substances, such as polyethylene or glass, however, can sustain permanent damage.

For example, the material 12 of FIG. 1 may employ a dielectric constant of about 3.5 to about 4.72.

EXAMPLE 5

As another example of the material 12, a casting and potting material, such as Stycast 2651-40 Catalyst-9 Epoxy having a dielectric strength of 17.7 MV/m, a dielectric constant of about 3.90 at 25° C., and being marketed by Emerson & Cuming of Canton, Mass., may be employed.

EXAMPLE 6

As another example of the material 12, a casting and potting material, such as EPON Resin 828/NMA/EMI-24—Anhydride Cure having a dielectric strength of 17.7 MV/m, a dielectric constant of about 3.26 at 25° C., and being marketed by Resolution Performance Products of Houston, Tex. may be employed.

EXAMPLE 7

As another example of the material 12, a casting and potting material, such as EPON Resin 828/PACM—Cycloaliphatic Cure having a dielectric strength of 17.7 MV/m, a dielectric constant of about 3.50 at 25° C., and being marketed by Resolution Performance Products of Houston, Tex. may be employed.

EXAMPLE 8

As an alternative to Examples 1 and 3–7, a wide range of other suitable materials may be employed depending upon the desired level of breakdown protection.

Referring to FIG. 2, the diagnostic sensor 2 and antenna 4 are shown in combination with a vacuum bottle 16 and the power bus 14 (e.g., flexible shunt or laminated conductor of a power bus) of a switchgear apparatus such as, for example, a circuit breaker 17 or other switchgear device including such a power bus 14. An example of a vacuum circuit breaker is disclosed in U.S. Pat. No. 6,373,358, which is incorporated by reference herein. For example, the vacuum bottle 16 includes separable contacts (not shown) of which a fixed contact (not shown) is electrically connected, for example, to a line bus (not shown) and, also, includes a moveable contact (not shown), which is electrically connected by the power bus 14 to, for example, a load conductor 18.

The diagnostic sensor 2 includes a suitable housing 20 (e.g., without limitation, a corona discharge shield; a conductive housing) including an opening 22 receiving the one or more antenna leads 10 (only one antenna lead 10 is shown in FIG. 2) therethrough. The housing 20 is mounted (e.g., without limitation, bolted to; strapped on; mechanically fixed to; or otherwise coupled to) proximate to or on a power bus, such as the load conductor 18. Alternatively, the housing 20 may be mounted proximate to or on any suitable power bus, such as a line bus (not shown). A suitable sensor circuit 24 is disposed in the housing 20. The sensor circuit 24 is adapted to output a radio frequency signal 26 to the antenna leads 10 or to input a radio frequency signal 28 from the antenna leads 10.

The circuit breaker 17 includes an internal wireless circuit 29 adapted to communicate with the sensor circuit 24 through the antenna element 6.

As shown in FIG. 2, the material 12 of the antenna 4 includes a surface 30, which is substantially larger than the opening 22 of the housing 20. The surface 30 is preferably suitably mounted on (e.g., coupled to; adhesively coupled; by flanging (not shown) the surface 30 and clipping (not shown) it to the housing 20; retained by employing suitably rigid antenna lead(s) 10) the housing 20, thereby covering the opening 22 thereof.

EXAMPLE 9

Figure 3:
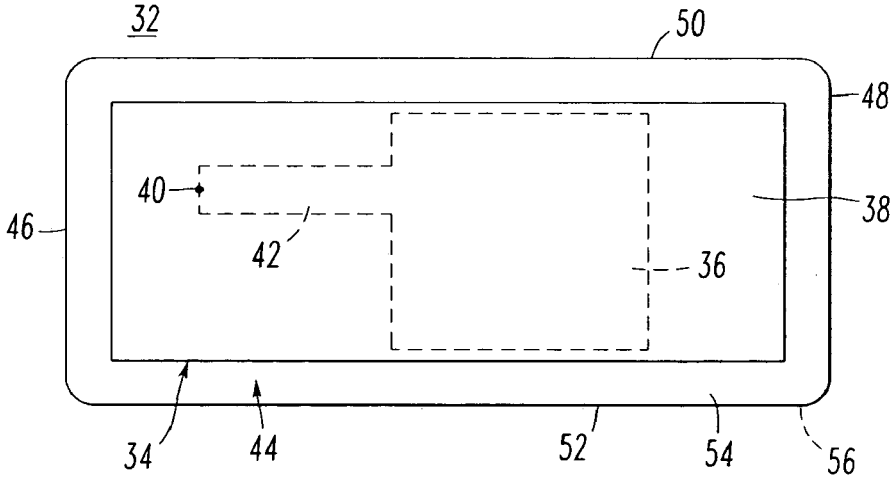
FIG. 3 is a plan view of an antenna in accordance with another embodiment of the invention.

FIG. 3 shows another antenna 32 including a patch antenna element 34. The patch antenna element 34 includes a radiating element 36 spaced suitably close to a parallel ground plane 38. One example of the patch antenna element 34 is a consumer-grade GPS antenna. Often, the implementation uses printed circuit board techniques, usually with a fiberglass dielectric. The driven element is sometimes circular, although square, rectangular (as shown in FIG. 3 with radiating element 36) and linear shapes may be employed. The radiating element 36 is usually fed at the edge, or a little way in from the edge, as shown, for example, at lead 40 through feed portion 42. The patch antenna element 34 functions as two slot dipoles side by side or as a resonant cavity with open sides that radiate.

In accordance with the invention, the antenna 32 also includes a material 44 substantially encapsulating the patch antenna element 34. Similar to the material 12 of FIGS. 1 and 2, the material 44 is adapted to suppress dielectric breakdown through such material to the encapsulated patch antenna element 34 from an external voltage potential.

The material 44 includes six surfaces 46,48,50,52,54,56 of which surface 46 is opposite and generally parallel to surface 48, surface 50 is opposite and generally parallel to surface 52, and surface 54 is opposite and generally parallel to surface 56 (shown in hidden line drawing). The encapsulated patch antenna element 34 may be disposed substantially intermediate the opposing surfaces 46,48, 50,52 and 54,56. The lead 40 protrudes through the surface 56, which may be disposed adjacent the housing 20 of FIG. 2. The lead 40 and another lead (not shown) for the ground plane 38 may enter the opening 22 of FIG. 2.

EXAMPLE 10

As an alternative to the spacing of FIG. 3, as shown in FIGS. 1 and 2, the surface 30 of the material 12 is a first planar surface and such material 12 includes a second planar surface 58 opposite the first planar surface 30. The antenna element 6 is generally disposed a first distance 60 from the first planar surface 30 and a second greater distance 62 from the second planar surface 58.

EXAMPLE 11

Figure 4:
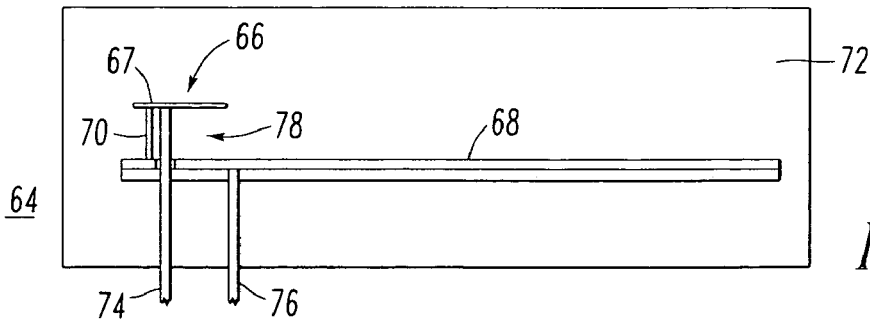
FIG. 4 is a vertical elevation view of another antenna in accordance with another embodiment of the invention.

FIG. 4 shows another antenna 64 including a planar inverted-F antenna (PIFA) element 66, which is, in general, achieved by short-circuiting its radiating patch or wire 67 to the antenna's ground plane 68 with a shorting pin 70. The PIFA element 66 can resonate at a relatively much smaller antenna size for a fixed operating frequency. Such PIFA designs usually occupy a compact volume.

In accordance with the invention, the antenna 64 also includes a material 72 substantially encapsulating the PIFA element 66. Similar to the material 12 of FIGS. 1 and 2, the material 72 is adapted to suppress dielectric breakdown through such material to the encapsulated PIFA element 66 from an external voltage potential. Leads 74 and 76 from the radiating patch or wire 67 and the ground plane 68, respectively, penetrate the material 72.

The region 78 between the radiating patch or wire 67 and the ground plane 68 may or may not employ an air substrate. For example, as shown in FIG. 4, the material 72 is disposed in the region 78.

EXAMPLE 12

Although the antenna elements 6, 34 and 66 of FIGS. 2, 3 and 4, respectively, include at least one square corner or square edge, as best shown in FIG. 1, the material 12 defines a surface which encapsulates the antenna member 8, the surface distal (i.e., any surface other than the surface 30) from the housing 20 excluding any square corner, excluding any square edge, and including a plurality of rounded corners 80,82,84,86 and a plurality of rounded edges 88,90, 92,94 (FIG. 1).

Alternatively, the surface 30 may include rounded corners and rounded edges (not shown) having a suitable radius (as measured from inside the material 12) like the surface 58. Alternatively, the surface 30 may be slightly larger than the surface 58 and include a tapered edge (not shown) having a suitable radius (as measured from outside the material 12).

The external surfaces of the housing 20 and the antenna 4 preferably have a suitable minimal surface texture, in order to minimize or eliminate sharp points.

The housing 20 may include a cover mounted to a base using a number of suitable methods (e.g., non-conductive fasteners, such as plastic screws). Preferably, the housing 20 employs rounded corners and rounded edges, as shown.

Figure 5:
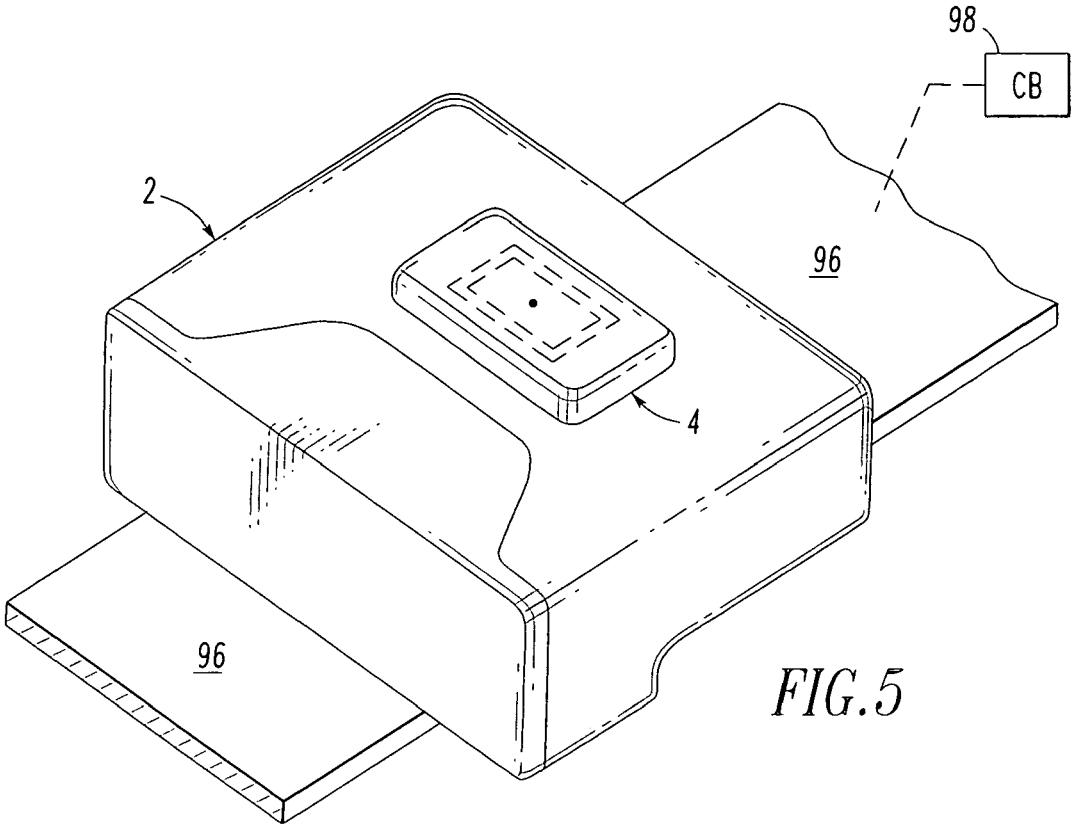
FIG. 5 is an isometric view of a bus structure including the diagnostic sensor and antenna of FIG. 1.

FIG. 5 shows a power bus structure 96 including the diagnostic sensor 2 of FIG. 1. The bus structure 96 is adapted to be electrically connected to a circuit breaker (CB), such as CB 98.

EXAMPLE 13

Figure 6:
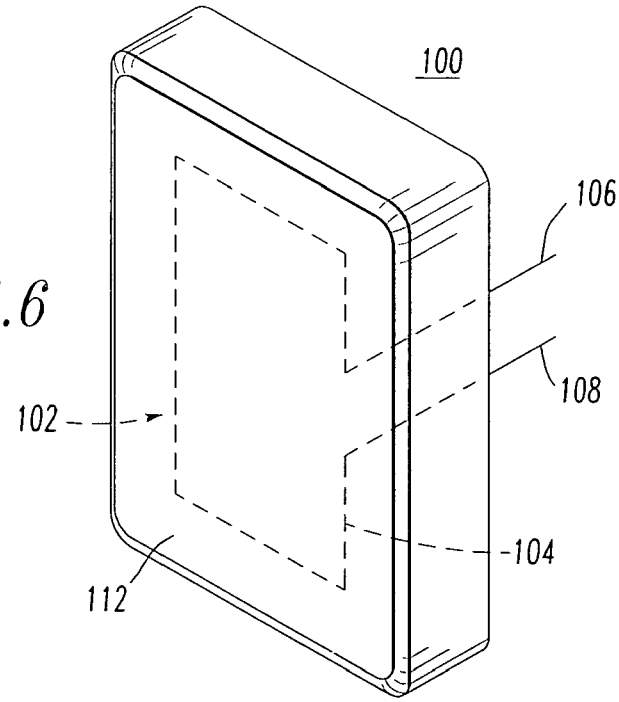
FIG. 6 is an isometric view of another antenna in accordance with another embodiment of the invention.

FIG. 6 shows an antenna 100, which is protected from dielectric breakdown, including a wire loop antenna element 102 having a loop antenna member 104 and two antenna leads 106, 108. The antenna 100 also includes a material 112 encapsulating the loop antenna member 104. Similar to the material 12 of FIG. 1, the material 112 is adapted to suppress dielectric breakdown through such material to the encapsulated loop antenna member 104 from an external voltage potential.

EXAMPLE 14

Although Examples 2 and 9–13 disclose different antenna examples, the invention is applicable to a wide range of antennas. As further non-limiting examples, a dipole antenna or a monopole antenna may be employed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A switchgear apparatus comprising:

a switchgear device comprising a power bus;

an antenna element comprising an antenna member and at least one antenna lead;

a material encapsulating said antenna member, said material being adapted to suppress dielectric breakdown through said material to said encapsulated antenna member from said power bus;

a conductive housing including an opening receiving said at least one antenna lead, said conductive housing being mounted on or proximate to said power bus; and a sensor circuit disposed in said conductive housing, said sensor circuit adapted to output a radio frequency signal to said at least one antenna lead or to input a radio frequency signal from said at least one antenna lead.

2. The switchgear apparatus of claim 1 wherein said switchgear device is a circuit breaker.

3. The switchgear apparatus of claim 2 wherein said circuit breaker includes an internal wireless circuit adapted to communicate with the sensor circuit through the antenna element.

4. The switchgear apparatus of claim 1 wherein said switchgear device is a bus structure; and wherein said power bus is adapted to be electrically connected to a circuit breaker.

* * * * *